US010711573B2

(12) United States Patent
Reid et al.

(10) Patent No.: US 10,711,573 B2
(45) Date of Patent: Jul. 14, 2020

(54) PRESSURE OPERATED APPARATUS AND METHOD

(71) Applicant: Weatherford U.K. Limited, Leicestershire (GB)

(72) Inventors: Stephen Reid, Loughborough (GB); Ian Jaffrey, Aberdeenshire (GB)

(73) Assignee: Weatherford U.K. Limited (GB)

( * ) Notice: Subject to any disclaimer, the term of this patent is extended or adjusted under 35 U.S.C. 154(b) by 212 days.

(21) Appl. No.: 15/749,667

(22) PCT Filed: Aug. 19, 2016

(86) PCT No.: PCT/GB2016/052584
§ 371 (c)(1),
(2) Date: Feb. 1, 2018

(87) PCT Pub. No.: WO2017/032989
PCT Pub. Date: Mar. 2, 2017

(65) Prior Publication Data

US 2018/0223629 A1 Aug. 9, 2018

(30) Foreign Application Priority Data

Aug. 23, 2015 (GB) ..... 1514968.5

(51) Int. Cl.
*E21B 34/10* (2006.01)
*E21B 34/08* (2006.01)
*E21B 23/04* (2006.01)

(52) U.S. Cl.
CPC ..... *E21B 34/103* (2013.01); *E21B 23/04* (2013.01); *E21B 34/08* (2013.01); *E21B 34/102* (2013.01)

(58) Field of Classification Search
CPC ..... E21B 34/103; E21B 34/102; E21B 34/08; E21B 34/085; E21B 34/00; E21B 34/101–108; E21B 23/04
See application file for complete search history.

(56) References Cited

U.S. PATENT DOCUMENTS

| | | | | |
|---|---|---|---|---|
| 3,889,751 | A | 6/1975 | Peters | |
| 4,339,001 | A * | 7/1982 | Paschal, Jr. | E21B 34/08 137/460 |
| 2014/0102718 | A1* | 4/2014 | Bjorgum | E21B 23/04 166/381 |

FOREIGN PATENT DOCUMENTS

| | | | |
|---|---|---|---|
| WO | 90/00668 | A1 | 1/1990 |
| WO | 2011/065843 | A1 | 6/2011 |
| WO | 2016/042328 | A1 | 3/2016 |

OTHER PUBLICATIONS

Int'l Search Report and Written Opinion in co-pending PCT Application No. PCT/GB2016/052584, dated Oct. 21, 2016, 11-pgs.

(Continued)

*Primary Examiner* — George S Gray
(74) *Attorney, Agent, or Firm* — Blank Rome, LLP

(57) ABSTRACT

A downhole apparatus comprises a piston mounted within a bore and being reconfigurable from a lock configuration to an unlock configuration in response to a pressure sequence applied within the bore. When the piston is in its lock configuration, a lock is supported by the piston such that the lock partially extends into the bore and engages a lock profile of the piston to restrict movement of the piston in a first direction towards its unlock configuration. In response to a first event of the pressure sequence, the piston is moveable in a second direction to desupport the lock and permit the lock to be wholly received into the bore and allow (Continued)

the piston to move in the second direction towards its unlock configuration in response to a subsequent event of the pressure sequence.

20 Claims, 9 Drawing Sheets

(56) References Cited

OTHER PUBLICATIONS

European Search Report in co-pending EP Appl. EP 19199346.8, dated Nov. 20, 2019, 7-pgs.

* cited by examiner

PRESSURE OPERATED APPARATUS AND METHOD

FIELD

The present invention relates to a pressure operated apparatus and method, for example for use in a downhole valve assembly.

BACKGROUND

In downhole oil and gas operations downhole equipment, such as downhole valves, sleeves, ICDs, packers, slips, toe sleeves and the like may be operated by use of pressure. For example, some equipment may be operated by use of hydrostatic pressure within the wellbore. In some cases equipment may be actuated by use of pressure differentials, for example between internal tubing pressure and external annulus pressures.

It is often the case in downhole operations that a defined sequence of events is required. However, if each event is pressure initiated, then there is a risk of the sequence being upset by a premature reaction of one event or device to a pressure meant for operation of a different event or device. For example, pressure testing is often required in downhole operations, such as to confirm the pressure integrity of completion strings following and/or during deployment. However, should the completion include one or more pressure activated devices then there is a risk that such devices are inadvertently actuated during pressure testing.

SUMMARY

An aspect or embodiment relates to a downhole pressure operated apparatus, comprising:

a piston member mounted within a piston bore and being reconfigurable from a lock configuration to an unlock configuration in response to a pressure sequence applied within the piston bore to facilitate an associated operation, wherein the piston member comprises a lock profile; and a lock member arranged in a cavity which opens into the piston bore, wherein when the piston member is in its lock configuration the lock member is supported by the piston member such that the lock member partially extends into the piston bore and engages the lock profile of the piston member to restrict movement of the piston member in a first direction towards its unlock configuration, wherein in response to a first pressure event of the pressure sequence the piston member is moveable in a second direction to desupport the lock member and permit said lock member to be wholly received into the piston bore and allow the piston member to move in the second direction towards its unlock configuration in response to a subsequent second pressure event of the pressure sequence.

The pressure operated apparatus may also be defined as a pressure operated lock.

The pressure operated apparatus may be utilised to operate, or actuate, any other tool, device, system or process. The pressure operated apparatus may also be defined as a pressure operated actuator.

Accordingly, the piston member may be reconfigured from its lock configuration to its unlock configuration in response to a pressure sequence applied within the piston bore, wherein the pressure sequence includes, at least, the first and subsequent second pressure events. The downhole pressure operated apparatus may thus be operated by establishing or effecting the required pressure sequence within the piston bore to effectively remove the restriction provided by the lock member, allowing the piston member to become configured in its unlock configuration and thus facilitate an associated operation. As will be described in further detail below, the associated operation may include any number of operations, such as mechanically or hydraulically releasing a mechanism, establishing, varying or restricting fluid communication between two fluid zones in a fluid system, opening or closing a flow path, operating an actuator, or the like.

In some embodiments the downhole pressure operated apparatus may form part of or define a downhole pressure operated valve. An aspect or embodiment may relate to a downhole pressure operated valve.

In some embodiments the downhole pressure operated apparatus may form part of or define a downhole actuator. An aspect or embodiment may relate to a downhole actuator.

The first and second pressure events may collectively define a pressure cycle of the pressure sequence. In one embodiment a single pressure cycle may operate the piston member to reconfigure from its lock configuration to its unlock configuration.

The first pressure event may comprise increasing or decreasing pressure within the piston bore, for example on one side of the piston member. This may cause a variation in a pressure differential across the piston member to thus cause movement of said piston member.

The second pressure event may comprise increasing or decreasing pressure within the piston bore, for example on one side of the piston member.

The first pressure event may comprise increasing pressure within the piston bore, and the second pressure event may comprise subsequently decreasing the pressure within the piston bore. Alternatively, the first pressure event may comprise decreasing pressure within the piston bore, and the second pressure event may comprise subsequently increasing the pressure within the piston bore.

The pressure operated apparatus may comprise a sealing arrangement located between the piston member and the piston bore, to permit a pressure differential across the piston member to be achieved to cause movement of the piston member. The sealing arrangement may comprise one or a number of seal members, such as O-rings.

The piston bore may be connectable to a source of fluid pressure, such that the piston bore may be configured or provided in pressure communication with a source of fluid pressure. The source of fluid pressure may be used to apply a pressure event within the piston bore to facilitate operation and reconfiguration of the piston member. The source of fluid pressure may be user manipulated to provide a deliberate pressure sequence to operate the piston member.

The pressure operated apparatus may comprise one or more ports to permit a pressure connection with a source of fluid pressure to be achieved.

The source of fluid pressure may comprise a downhole source of pressure, for example within a tubing string, completion string, production string, wellbore annulus or the like.

The piston bore may be connectable to an internal volume of a tubing string, such as a completion string, such that pressure within the tubing string may be applied within the piston bore. In this arrangement the pressure within the tubing string may be used to operate the piston member. For example, a user or operator may vary the pressure within the tubing string, for example by using surface equipment such as pumps, chokes or the like. Alternatively, or additionally, the pressure within the tubing string may act as a biasing pressure within the piston bore, for example to seek to bias the piston member in a desired direction, against the action of another force (such as a mechanical force, pressure force or the like) acting on the piston member.

The piston bore may be connectable to a wellbore annulus region, such that pressure within the wellbore annulus region may be applied within the piston bore. In this arrangement the pressure within the wellbore annulus may be used to operate the piston member. For example, a user or operator may vary the pressure within the wellbore annulus, for example by using surface equipment. Alternatively, or additionally, the pressure within the wellbore annulus may act as a biasing pressure within the piston bore, for example to seek to bias the piston member in a desired direction, against the action of another force (such as a mechanical force, pressure force or the like) acting on the piston member.

The pressure operated apparatus may comprise a pressure transfer arrangement for facilitating transfer of pressure between a pressure source, for example from a downhole pressure source such as a tubing string, wellbore annulus or the like, and the piston bore. The pressure transfer arrangement may facilitate pressure transfer from a pressure source, while preventing direct fluid communication with the pressure source. This may minimise the risk of fluids within the pressure source potentially contaminating and compromising the pressure operated apparatus.

The pressure transfer arrangement may comprise a moveable pressure interface, wherein one side of the pressure interface may be exposed to the pressure source (such as an internal volume of a tubing string, wellbore annulus or the like), and an opposite side of the pressure interface may be exposed to a pressure transfer medium. In this way, pressure applied by the pressure source on the pressure interface will be transferred to the pressure transfer medium. The pressure transfer medium may comprise a fluid, such as mineral oil, a gel or the like. In some embodiments the pressure transfer medium may comprise a compressible fluid, for example a compressible liquid, such as Silicon.

The piston member may be biased by a bias force in one of the first and second directions. In this arrangement a pressure applied within the piston bore may act together with the bias force to facilitate appropriate movement of the piston member in the first and second directions. For example, a pressure applied within the piston bore may establish a force on the piston member to overcome the bias force, and thus cause movement of the piston member in the desired direction. A pressure applied within the piston bore may establish a force on the piston member which is lower than the bias force, thus allowing the bias force to cause movement of the piston member in the desired direction.

The pressure operated apparatus may comprise a biasing arrangement. The biasing arrangement may be arranged to act on one side of the piston member.

The pressure operated apparatus may comprise a mechanical biasing arrangement, such as a spring or spring assembly.

The pressure operated apparatus may comprise a fluid biasing arrangement. The fluid biasing arrangement may function as a fluid spring. The fluid biasing arrangement may comprise a pressure arrangement for applying fluid pressure from a downhole region, such as a wellbore annulus region. Such pressure may be applied directly or indirectly. The pressure arrangement may comprise a fluid port. The pressure arrangement may comprise a pressure transfer device. Such a pressure transfer device may isolate the valve assembly from direct contact with downhole fluids.

The fluid biasing arrangement may comprise a biasing fluid volume. Pressure within the biasing fluid volume may be pre-set, for example set during manufacture, during commissioning or the like.

Pressure in the fluid volume may be increased during movement of the piston member in one direction.

The fluid volume may be variable, for example expandable and/or contractable, for example elastically expandable and/or contractable. In one embodiment upon movement of the piston member fluid may be transferred into the expandable volume. By virtue of elastic expansion an effective increase in fluid pressure may be attained, acting to bias the piston member against movement.

The variable volume may be in pressure communication with a wellbore region, such as a wellbore annulus region. Accordingly, fluid pressure acting in the wellbore region may be effectively transferred to fluid within the variable volume, and thus to the piston member.

The expandable volume may comprise an elastic tube, such as a tube formed from a rubber, such as Viton.

The fluid biasing arrangement may comprise a compressible fluid, for example a compressible liquid, such as Silicon. Such compressibility may permit the piston member to be moveable even when a variable volume is not present. Such an arrangement may minimise hydraulic lock within the valve assembly. In some embodiments the use of a compressible fluid may provide contingency in the event that an initially expandable volume is compromised, for example in the event of the expandable volume being encased in cement.

The fluid biasing arrangement may comprise a pressure transfer medium used to permit a pressure event to be established within the piston bore. Such a pressure transfer medium may comprise a compressible fluid, such as a compressible liquid. The fluid biasing arrangement may comprise a pressure transfer medium of a pressure transfer arrangement, such as described above.

In one embodiment the pressure operated apparatus may comprise a fluid control arrangement which facilitates controlled communication of a pressure transfer medium between opposing first and second sides of the piston member. In such an arrangement the same pressure transfer medium may be used as both a medium to apply a pressure event within the piston bore on a first side of the piston member while at the same time provide a biasing force on an opposite second side of the piston member.

The fluid control arrangement may comprise a first flow path comprising a fluid restriction. The first flow path may permit opposing sides of the piston member to become pressure balanced in a static mode of operation, for example balanced to each other and to a source of fluid pressure. The fluid restriction may permit a back pressure to be generated on one side of the piston member during a dynamic mode of operation. That is, a backpressure may be generated during flow of transfer medium through the fluid restriction in at least a first direction from the first side to the second side of the piston member. This back pressure may permit the pressure on the first side of the piston member to be elevated above the pressure on the second side of the piston member, thus allowing a pressure differential to be established to move the piston member. The pressure transfer medium may be compressible to permit movement of the piston member when a pressure differential is present.

The fluid control arrangement may comprise a second flow path comprising a one way or check valve. The one way valve may permit flow therethrough in a second direction from the second side of the piston member to the first side. The one way or check valve may permit relief of fluid from the second side of the piston member, for example in the event of pressure at said second side exceeding the pressure within the first side. The second flow path and one way or check valve may permit a more rapid pressure equalisation than permitted via the fluid restrictor. Accordingly, following a pressure event equalisation may be relatively rapidly achieved, thus permitting a subsequent pressure cycle to be performed quicker, than would be achievable relying on equalisation via the fluid restrictor of the first flow path.

One or both of the first and second flow paths may be provided within the piston member. One or both of the first and second flow paths may be provided separately from the piston member.

The piston member may be mounted within the piston bore to define first and second chambers. The first and second chambers may be isolated from each other, for example via a sealing arrangement. Pressure events may be provided in one or both of the first and second piston chambers to establish movement of the piston member.

In one embodiment the first chamber may be arranged to accommodate pressure events for use in operation of the piston member, and the second chamber may accommodate a biasing arrangement.

In one embodiment the pressure operated apparatus may be configured such that the lock member may be received within one of the first and second chambers during reconfiguring of the piston member in response to the pressure sequence.

One or both of the first and second chambers may be connectable to a source of fluid pressure, wherein said source of fluid pressure may be used to apply a pressure event within the piston bore to facilitate operation and reconfiguration of the piston member towards its unlock configuration.

The pressure operated apparatus may comprise a plurality of lock members located within the cavity. The lock members may sequentially engage and release the piston member in response to multiple sequential pressure events, or pressure cycles, applied within the piston bore, until a final lock member is wholly received into the piston bore, allowing the piston member to move in the second direction towards its unlock configuration. This arrangement may permit multiple pressure cycles to be performed before the piston member is reconfigured to its unlocked position. Such multiple pressure cycles may therefore be used for other purposes, such as operating other tools, systems or equipment, pressure integrity testing or the like.

A first lock member may be initially supported by the piston member such that the first lock member partially extends into the piston bore and engages the lock profile of the piston member to restrict movement of the piston member in a first direction towards its unlock configuration. In response to a first pressure event (e.g., increasing pressure) applied within the piston bore the piston member may be moveable in the second direction to desupport the first lock member and permit said first lock member to be wholly received into the piston bore. In response to a second pressure event (e.g., decreasing pressure) applied within the piston bore the piston member may be moveable in the second direction until a second lock member becomes supported by the piston member such that the second lock member partially extends into the piston bore and engages the lock profile of the piston member to restrict movement of the piston member in the first direction towards its unlock configuration.

This sequence may be repeated until a final lock member is wholly received into the piston bore, allowing the piston member to move in the second direction towards its unlock configuration.

The piston member may be axially moveable within the piston bore. Alternatively, or additionally, the piston member may be rotatably moveable within the piston bore.

The lock profile of the piston member may comprise an axial lock surface which axially engages the lock member to restrict axial movement of the piston member. The lock profile may comprise a radial support surface. The radial support surface may support the lock member in a position which is partially extended into the piston bore. Movement of the piston member in the second direction may misalign the lock member from the radial support surface, allowing the lock member to be desupported and wholly received within the piston bore.

The lock profile may be provided by a notch formed on the piston member, for example formed in an end of the piston member.

The pressure operated apparatus may comprise a lock member restrictor to prevent multiple lock members from being received into the piston bore during a single movement of the piston member in response to a single pressure event in the piston bore. The lock member restrictor may comprise a displaceable member which temporarily captures a lock member upon initial entry to the piston bore and thus holding any subsequent lock members within the cavity, until the piston member may move in its second direction to provide support to a subsequent lock member. Movement of the piston member in its second direction may provide a necessary force on the lock member located within the piston bore to move the displaceable member, thus preparing for a subsequent operation cycle. The lock member restrictor may comprise a spring mounted ball.

The lock member may be biased in a direction to move into the piston bore. The lock member may be spring biased, for example.

The lock member may comprise a ball.

The pressure operated apparatus may be locatable within a wall structure of a tubing string, such as a completion string.

The piston bore may be directly formed within a wall of a tubing string.

The pressure operated apparatus may comprise a housing defining the piston bore.

The piston member may define a mechanical lock. In one embodiment the piston member may engage a device to provide locking of said device when the piston member is in its lock configuration. The piston member may disengage the device to provide unlocking of said device when the piston member is reconfigured to its unlock configuration.

The piston member may define a valve member. The piston member may define a valve spool.

The piston member may be arranged to initially isolate fluid communication between first and second fluid zones when said piston member is in its lock configuration, and then establish fluid communication between the first and second fluid zones when said piston member is in its unlock configuration.

In one embodiment initial fluid isolation may prevent an actuation fluid from being delivered to a target, with the actuation fluid eventually permitted to be communicated between the first and second fluid zones when the piston member is configured in its unlock configuration.

In one embodiment initial fluid isolation may maintain a hydraulic lock in one of the first and second fluid zones. This hydraulic lock may secure another apparatus, system or component in a desired state. For example the hydraulic lock may secure a locking sleeve of a valve mechanism in place, preventing operation of the valve mechanism. Subsequent communication between the first and second fluid zones may permit the hydraulic lock to be released. In one embodiment the first zone may define a region of initial hydraulic lock at a first pressure (for example local downhole ambient pressure), and the second zone may define an lower pressure region (for example a region at atmospheric pressure), allowing the fluid from the first zone to be relieved into the second zone when the piston member is configured in its unlock configuration.

The piston member may comprise a latch arrangement configured to latch the piston member in its unlock configuration. Such a latch arrangement may comprise a snap-ring arrangement or the like.

The piston member may be initially rigidly secured relative to the piston bore by a releasable mechanism. The releasable mechanism may be defined by, for example, a shearing mechanism, such as by one or more shear screws. The releasable mechanism may be released upon initial movement of the piston member in its first direction.

An aspect or embodiment relates to a downhole method, comprising:

providing a piston member of a pressure operated apparatus in an initial lock configuration within a piston bore, wherein said piston member is retained in said lock configuration by a lock member which is supported by the piston member such that the lock member partially extends into the piston bore and engages the lock profile of the piston member to restrict movement of the piston member in a first direction towards an unlock configuration;

establishing a first pressure event within the piston bore to move the piston member in a second direction to desupport the lock member and permit said lock member to be wholly received into the piston bore; and establishing a second pressure event within the piston bore to move the piston member in the second direction towards its unlock configuration and facilitate an associated operation.

The method may comprise providing multiple lock members which sequentially engage and retain the piston member in its lock configuration upon applying multiple pressure cycles comprising first and second pressure events within the piston bore, until a final lock member is wholly received into the piston bore, allowing the piston member to move in the second direction towards its unlock configuration.

The method may be performed by a downhole pressure operated apparatus according to any other aspect.

An aspect or embodiment relates to a pressure operated apparatus, comprising:

a piston member mounted within a piston bore and being reconfigurable from a lock configuration to an unlock configuration to facilitate an associated operation; and a lock member, wherein when the piston member is in its lock configuration the lock member is partially extends into the piston bore to restrict movement of the piston member in a first direction towards its unlock configuration, and wherein in response to a first pressure event applied within the piston bore the piston member is moveable in a second direction to permit the lock member to be wholly received into the piston bore and remove the restriction to movement of the piston member in the first direction.

An aspect or embodiment relates to a pressure operated apparatus, comprising:

a piston member mounted within a piston bore and being reconfigurable from a lock configuration to an unlock configuration to facilitate an associated operation; and a plurality of lock members, arranged to sequentially restrict movement of the piston member towards its unlock configuration, wherein the piston member is reciprocally moveable within the piston bore in response to sequential pressure events applied within the piston bore to sequentially move the lock members from a first retaining position to a second release position, until all lock members are moved to their second release position to permit the piston member to be reconfigured to its unlock position.

Aspects or embodiments relate to a downhole completion system comprising a pressure operated apparatus of any other aspect.

Aspects or embodiments relate to a downhole method using a pressure operated apparatus of any other aspect.

It should be understood that the features defined in relation to one aspect may be provided in combination with any other aspect.

BRIEF DESCRIPTION OF THE DRAWINGS

These and other aspects or embodiments will now be described, by way of example only, with reference to the accompanying drawings, in which.

DETAILED DESCRIPTION OF THE DRAWINGS

Figure 1A:
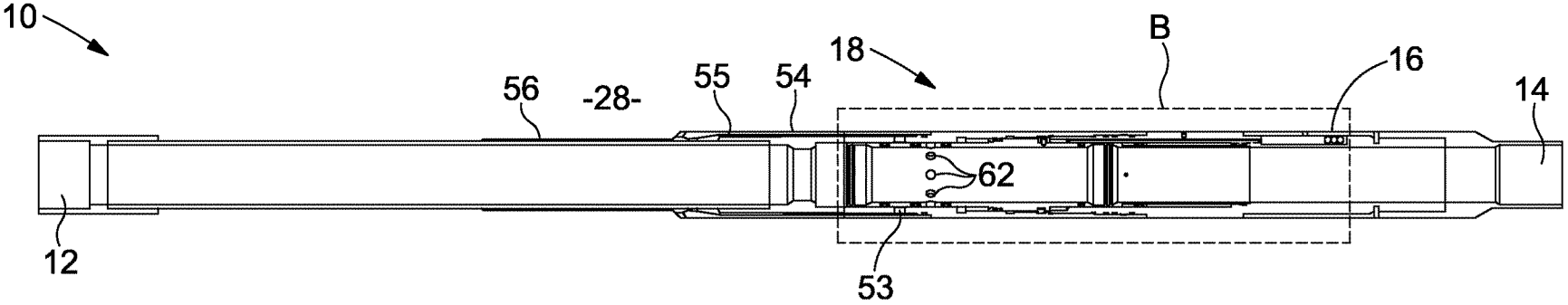
FIG. 1A is a diagrammatic illustration of a completion system which includes a pressure operated apparatus according to an embodiment of the present invention, wherein the completion system includes an ICD in a closed configuration.

Aspects relate to a pressure operated apparatus which may be used to provide operation to any other tool, system, device or process. Some example uses are presented below.

FIG. 1 is a diagrammatic illustration of a completion system, generally identified by reference numeral 10, in accordance with an embodiment of the present invention. The completion system 10 includes threaded connectors 12, 14 at opposing ends thereof to facilitate securing in-line with a completion string (not shown).

The completion system 10 includes a pressure operated apparatus, generally identified by reference numeral 16, and a downhole tool 18 which is to be actuated by or via the apparatus 16. In the present illustrated embodiment the downhole tool 18 is an ICD, although any other tool or system may be used.

Figure 1B:
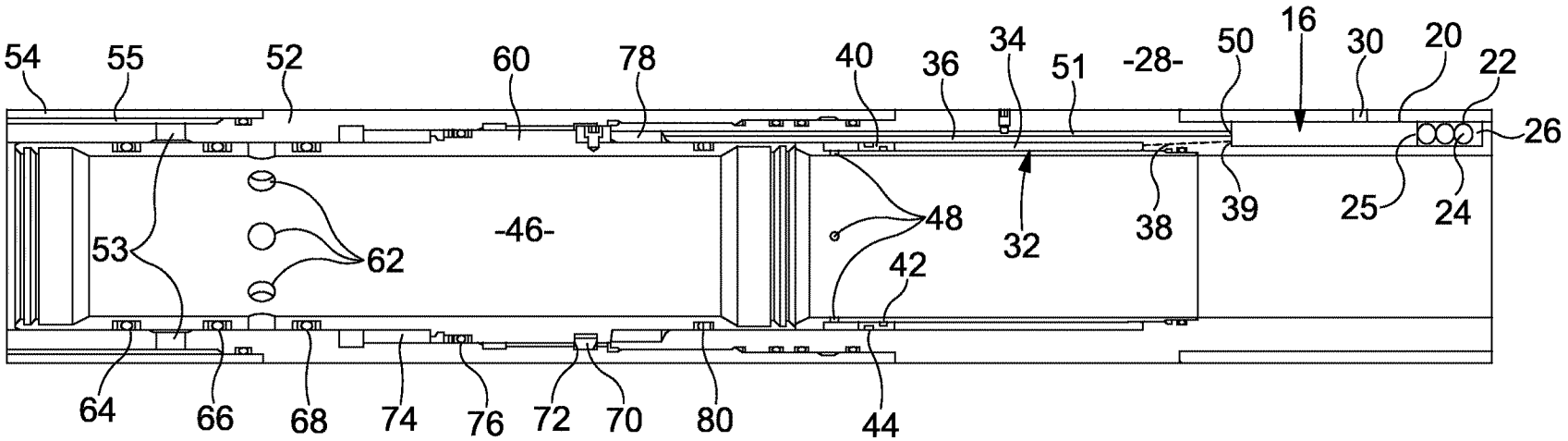
FIG. 1B is an enlarged view of the region B in FIG. 1A.

An enlarged view of the completion system 10 in the region B of FIG. 1A is provided in FIG. 1B, reference to which is now made. The apparatus 16 is provided within a wall region 20 of the completion system 10. A flexible reservoir tube 22 containing an actuation fluid 24 is in communication with the apparatus 16 via port 25. As will be described in more detail below, the actuation fluid 24 is used, upon operation of the apparatus 16, to actuate the tool 18.

In the present embodiment the reservoir tube 22 is formed of an elastic material, for example a rubber such as Viton, which is coiled or laid in serpentine form within a pocket 26 formed in the wall region 20. The pocket 26 is in communication with a space 28 external of the completion system 10 (which may be an annulus space) via a port 30, such that external pressure may act on the outer surface of the tube 22, and thus impart the external pressure to the actuation fluid. The tube 22 permits pressure communication while preventing communication of fluids between the external space 28 and the apparatus 16 or tool 18. This may minimise the risk of contamination and possible compromise/damage of the apparatus 16 or tool 18.

The completion system 10 includes a pressure transfer arrangement, generally identified by reference numeral 32, which includes a reservoir of a pressure transfer fluid 34 provided in an annular space 36, wherein the pressure transfer fluid is in communication with the apparatus 16 via communication path illustrated by broken line 38 and port 39. The pressure transfer arrangement 32 further comprises an annular piston 40 positioned within the annular space 36, sealed against the inner and outer walls of the annular space 36 by respective inner and outer seals 42, 44. The annular piston 40 is arranged such that one side thereof is in communication with the pressure transfer fluid 34, and an opposing side is in communication with a central bore 46 of the completion system 10 via ports 48. Accordingly, the pressure of the pressure transfer fluid 34, and thus the pressure delivered to the apparatus 16, may be substantially equalised with the internal pressure of the completion system 10. The provision of the annular piston 40 provides the ability to impart the completion pressure into the pressure transfer fluid 34, while minimising the risk of fluid contamination, which may otherwise compromise the apparatus 16.

The apparatus 16 includes or defines an actuation fluid outlet 50 which is in fluid communication with the ICD 18 via flow path 51.

As will be described in more detail below, the pressure within the completion system 10 may be varied by a user or operator in a defined sequence to operate the apparatus 16 to eventually open a communication path between the actuation fluid 24 and the tool 18 to permit actuation of said tool 18.

The ICD 18 includes a housing 52 which includes a number of circumferentially arranged ports 53. An outer shroud 54 surrounds the ports 53, wherein the shroud 54 defines an annular flow path 55 within the housing 52. A screen material 56 (see FIG. 1A) closes an end of the annular flow path 55 such that inflow from the external space 28 surrounding the completion system 10 (the wellbore annulus) is permitted through the screen material 56, which functions as a filter.

The ICD 18 further includes a sleeve 60 mounted internally of the housing 52, wherein the sleeve 60 includes a plurality of circumferentially arranged ports 62. In the configuration shown in FIG. 1B the sleeve 60 is in a closed position, such that the ports 62 of the sleeve 60 are misaligned from the ports 53 in the housing 52, preventing inflow. A number of O-ring seals 64, 66, 68 are axially placed along the outer surface of the sleeve 60, and when in the closed position seals 64 and 66 straddle the ports 53 to provide sealing of said ports 53. The sleeve 60 is held within this closed position by a bevelled-edge snap ring 70 secured to the sleeve 60 and received within an annular recess 72 formed in the inner surface of the housing 52.

A first chamber 74 is defined between the sleeve 60 and the housing 52, wherein said first chamber 74 is provided at atmospheric pressure. O-ring seal 68 co-operates with a further seal 76 to isolate the first chamber 74.

A second chamber 78 is defined between the sleeve 60 and the housing 52 (and other wall sections of the completion system 10). The second chamber 78 is isolated via the seal 76 and a further seal 80. The flow path 51 from the fluid outlet 50 of the apparatus 16 is in communication with the second chamber 78.

As will be described in more detail below, in use, fluid pressure within the bore 46 of the completion system 10 may be varied to eventually establish communication of the actuation fluid 24, through the apparatus 16, along the flow-path 51 and into the second chamber 78. When the pressure force is sufficient the snap ring 70 will be disengaged to allow the sleeve 60 to move to open the ports 53 in the housing.

Figure 2:
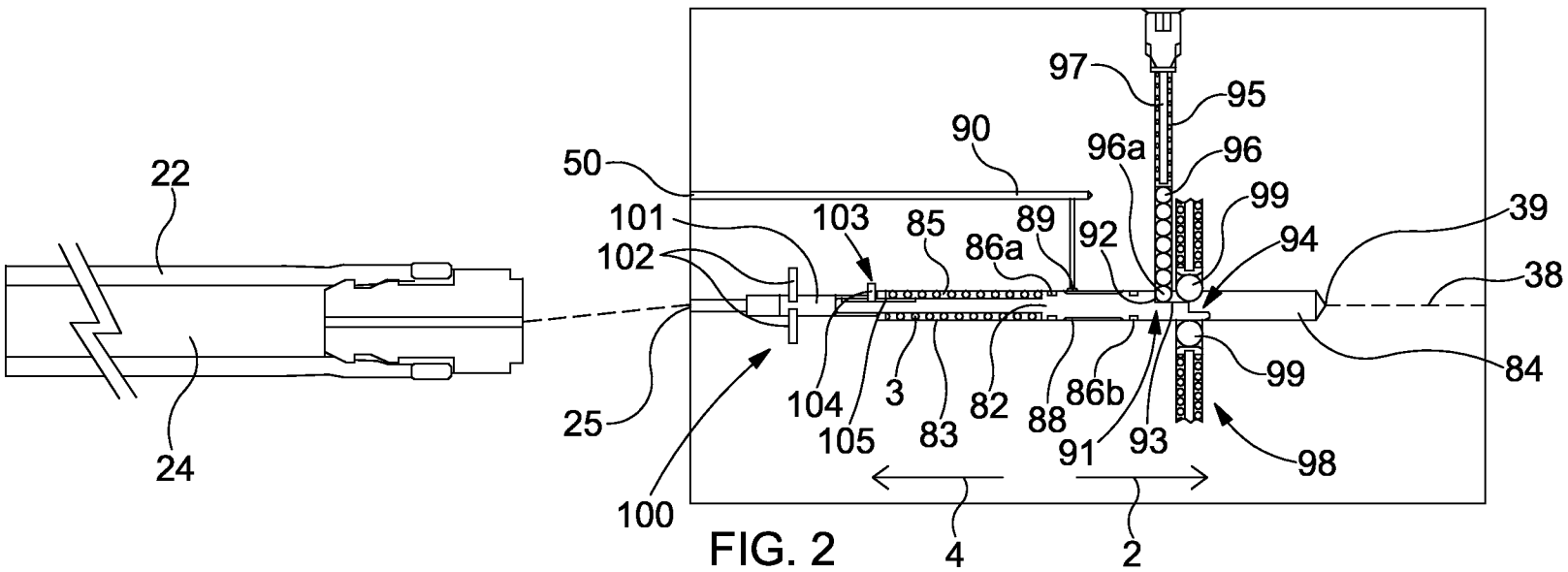
FIG. 2 is a diagrammatic illustration of a pressure operated apparatus in accordance with one embodiment of the present invention.

FIG. 2 is a diagrammatic cross-sectional illustration of the apparatus 16, shown in an initial state, which may be defined as a lock configuration. The apparatus 16 includes a piston member 82 mounted within a piston bore 83 to define a first chamber 84 on one side of the piston member 82 and a second chamber 85 on an opposite side of the piston member 82.

The first chamber 84 is provided in communication with the pressure transfer fluid 34 (FIG. 1B) via communication path 38 and port 39. Thus, the pressure within the completion system 10 is applied within the first chamber 84. The second chamber 85 is in communication with the actuation fluid 24 within the actuation tube 22 via port 25. Thus, the pressure within the actuation tube 22, which may be equalised with the pressure in the space 28 external to the completion system 10 (the wellbore annulus), is applied within the second chamber 85.

It will be recognised that the pressure of the actuation fluid 24 applied within the second chamber 85 will act on the piston member 82 to urge said piston member 82 to axially move within the piston bore 83 in a first direction, illustrated by arrow 2. Further, in addition to the action of the pressure of the actuation fluid 24, the piston member 82 is also biased in the first direction by a spring 3.

The pressure of the pressure transfer fluid 34 applied within the first chamber 84 will act on the piston member 82 to urge said piston member 82 to axially move within the piston bore 83 in an opposite second direction, illustrated by arrow 4. Thus movement of the piston member will be provided in accordance with the resolution of the various forces applied on the piston member 82 in the first and second directions 2, 4, and also in accordance with a locking arrangement, which will be described below.

Two axially spaced O-ring seals 86*a*, 86*b* are mounted on the piston member 82 and provide sealing between the piston member 82 and the piston bore 83, isolating the first and second chambers 84, 85. An axial space 88 is defined between the O-rings 86*a*, 86*b*. In the illustrated initial configuration the piston member 82 is positioned such that the O-rings 86*a*, 86*b* and axial space 88 straddle a port 89 of an internal flow path 90 which extends to the port 50 providing communication with the flow path 51 (FIG. 1B). Accordingly, in the illustrated configuration the actuation fluid 24 is isolated by the piston member 82 from the internal flow path 90, and thus flow path 51, such that actuation of the ICD 18 is prevented.

One end of the piston member 82 comprises a locking profile which includes a locking notch 91 having an axially facing locking surface 92 and a radially facing support surface 93. The locking profile also includes a relief notch 94 provided axially adjacent the locking notch 91.

Figure 3:
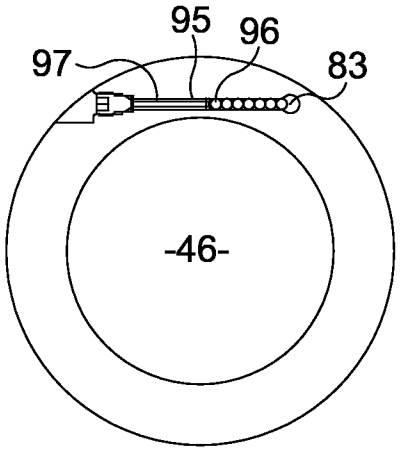
FIG. 3 is a lateral cross-sectional view of a tubing string which includes the pressure operated apparatus of FIG. 2.

The apparatus 16 further comprises a cavity 95 in the form of a drilled bore which opens into the piston bore 83. A plurality of locking members 96 in the form of balls are stacked within the cavity 95, and are biased by a spring arrangement 97 towards the piston bore 83. As illustrated in FIG. 3, the cavity 95 extends in a non-radial orientation, allowing an increased number of locking members 96 to be held.

Referring again to FIG. 2, with the piston member 82 in its initial illustrated position/configuration a first locking member 96*a* extends from the cavity 95 and only partially into the piston bore 83, being supported by the radial support surface 93 of the locking profile. When in this position the axial locking surface 92 of the locking profile axially engages the first locking member 96*a*, such that said locking member 96*a* restricts movement of the piston member in the first direction 2, thus maintaining the piston member 82 in its lock configuration.

The apparatus 16 also comprises a lock member restrictor 98 which includes a pair of spring mounted balls 99. The purpose and function of the lock member restrictor 98 will become apparent from the description below.

The apparatus 16 further comprises a releasable mechanism 100 which includes a rod 101 secured within the piston bore via a plurality of shear screws or pins 102. When in the initial configuration as illustrated in FIG. 2, the releasable mechanism 100 prevents any movement of the piston member 82 in the second direction, at least until the releasable mechanism is released by shearing of the screws or pins 102.

The apparatus further comprises an anti-rotation arrangement 103 which includes a key 104 extending from a side wall of the piston bore 83 and received within an axial keyway 105 formed in the piston member 82. In use, the anti-rotation arrangement 103 permits axial movement of the piston member 82, but prevents rotational movement, thus maintaining correct alignment of the locking profile.

The operational sequence of the apparatus 16 will now be described with reference to FIGS. 4A to 4C.

Figure 4A:
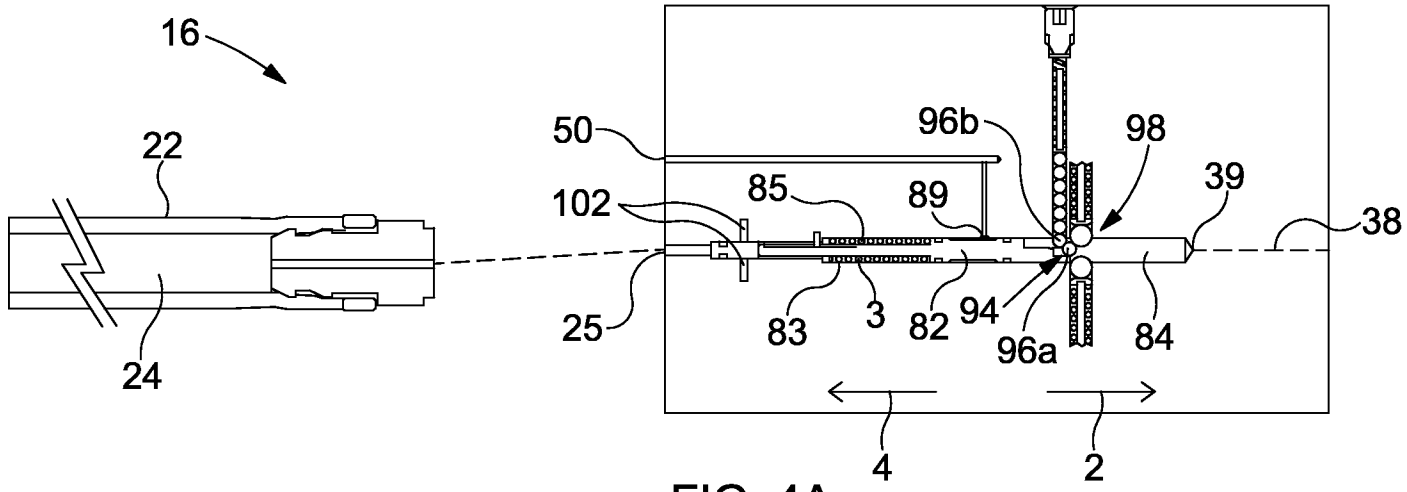
FIGS. 4A to 4C are diagrammatic sequential illustrations of the use of the pressure operated apparatus of FIG. 2.

Referring initially to FIG. 4A, when the apparatus 16 is to be operated pressure within the completion system 10 (within bore 46—FIG. 1B) is elevated, thus increasing the pressure within the first chamber 84. This increase of pressure within the first chamber 84 may be defined as a first pressure event. When this first pressure event generates a force on the piston member 82 which exceeds the rating of the shear screws or pins 102, in combination with the bias force from the spring 3 and the pressure of the actuation fluid (e.g., annulus pressure) acting in the second chamber 85, the piston member 82 will move axially in the second direction 4. This will cause the first lock member 96*a* to become aligned with the relief notch 94 of the locking profile on the piston member 82, permitting the first lock member 96*a* to be wholly received within the piston bore 83, specifically within the first chamber 84. A subsequent or second lock member 96*b* then becomes partially extended into the piston bore 83. The second lock member 96*b* is prevented from wholly entering the piston bore 83 by the first lock member 96*a*, which is retained by the lock member restrictor 98.

When in this configuration the fluid port 89 remains isolated, such that the ICD 18 is not yet actuated.

Figure 4B:
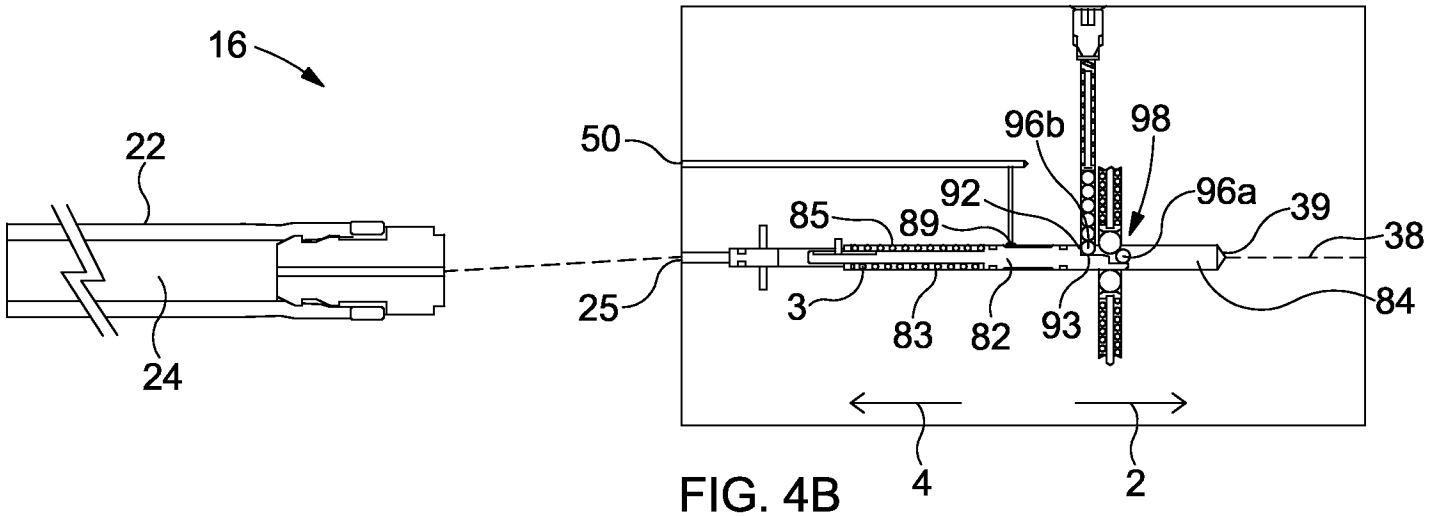
Figure 4C:
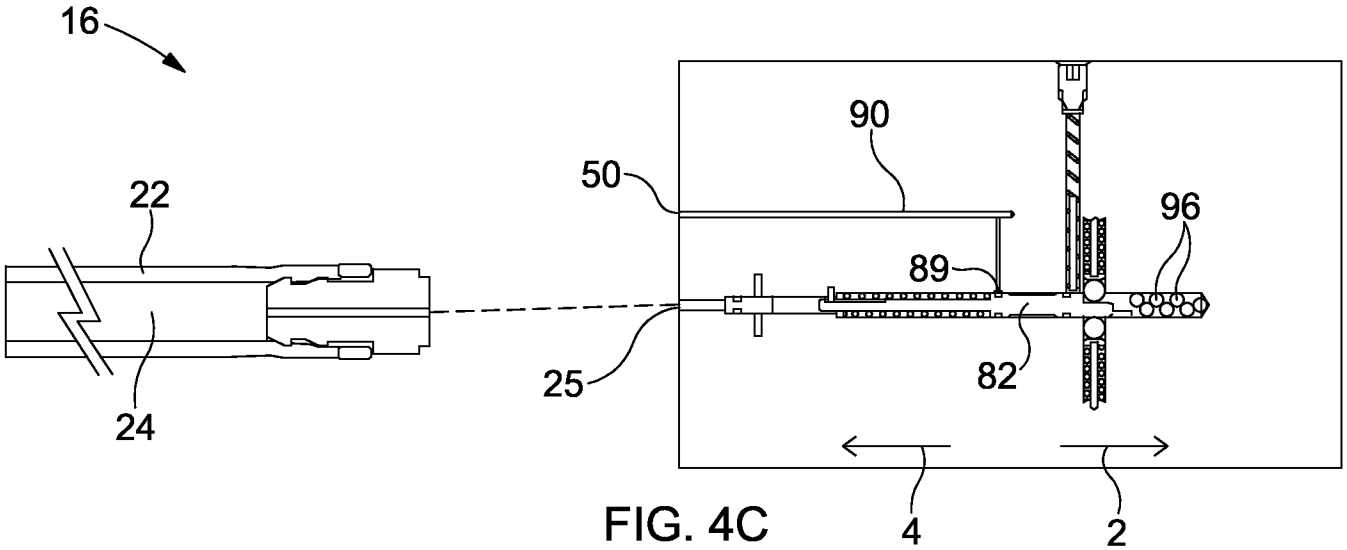

Following this, as illustrated in FIG. 4B, the pressure within the completion system 10 (within bore 46—FIG. 1B) is reduced, thus reducing the pressure within the first chamber 84. This reduction of pressure within the first chamber 84 may be defined as a second pressure event. When the combined resultant force of the bias spring 3 and the pressure of the actuation fluid 24 acting in the second chamber 85 exceeds that provided by pressure within the first chamber 84, the piston member 82 will move axially in the first direction 2. Such movement will force the first lock member 96*a* past the lock member restrictor 98, and will allow the second lock member 96*b* to become supported by the radial support surface 93 of the locking profile of the piston member. Thus, the second lock member 96*b* now restricts further movement of the piston member 82 in the first direction 2 by engagement with the axial locking surface 92 of the locking profile on the piston member 82. The fluid port 89 thus remains isolated or closed.

The first and second pressure events (increasing and then decreasing pressure) may collectively define a pressure cycle which establishes a single count within the apparatus 16. Such a pressure cycle may be repeated until all locking members 96 wholly enter the piston bore 83, as illustrated in FIG. 4C. When in this configuration the piston member 82 is no longer restricted and is free to move further in the first direction 2, until the fluid port 89 is no longer isolated, thus establishing fluid communication between the actuation fluid 24 and the ICD 18. This final configuration of the piston member 82 may be defined as its unlock configuration. Although not illustrated, the piston member 82 may be mechanically secured, for example by a snap-ring, within this unlock configuration.

Figure 5:
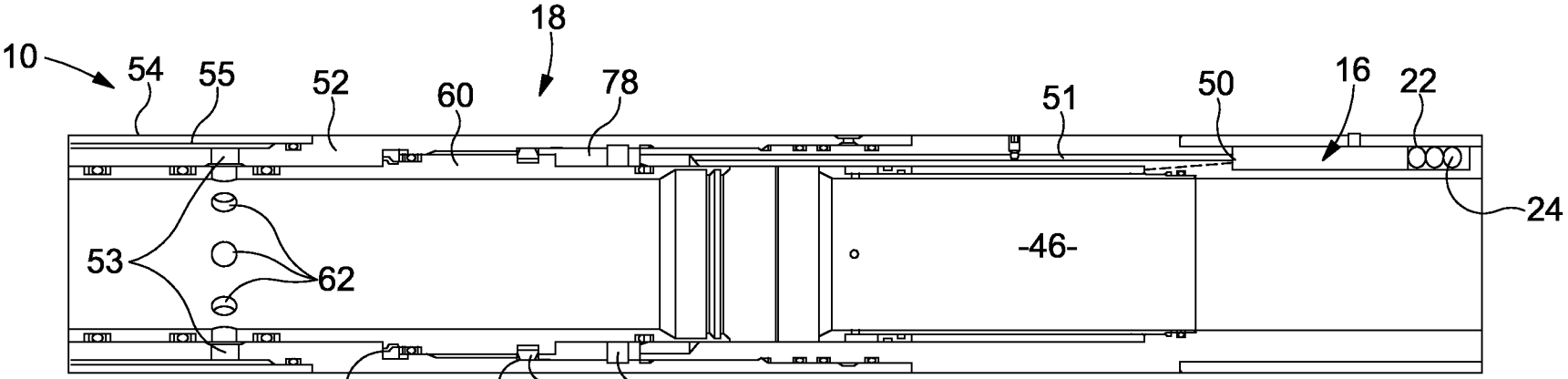
FIG. 5 illustrates the ICD of FIG. 1A in an open position.

As illustrated in FIG. 5, the actuation fluid 24 is delivered from apparatus 16 (driven by the pressure within the wellbore annulus 28), via the port 50 and flow path 51 into the second chamber 78. When sufficient pressure is achieved the bevelled snap ring 70 is disengaged from recess 72 and the sleeve 60 is moved to an open position in which the ports 62 of the sleeve 60 become aligned with the ports 53 in the housing 52, opening the ICD 18. The snap ring 70 engages a second recess 106 to assist to hold the sleeve 60 in this open position.

The pressure operated apparatus may be used in combination with any tool or system, and is not restricted for use with the exemplary ICD tool 18 described above. A second exemplary use will now be described with reference to FIGS. 6A to 8B.

Figure 6A:
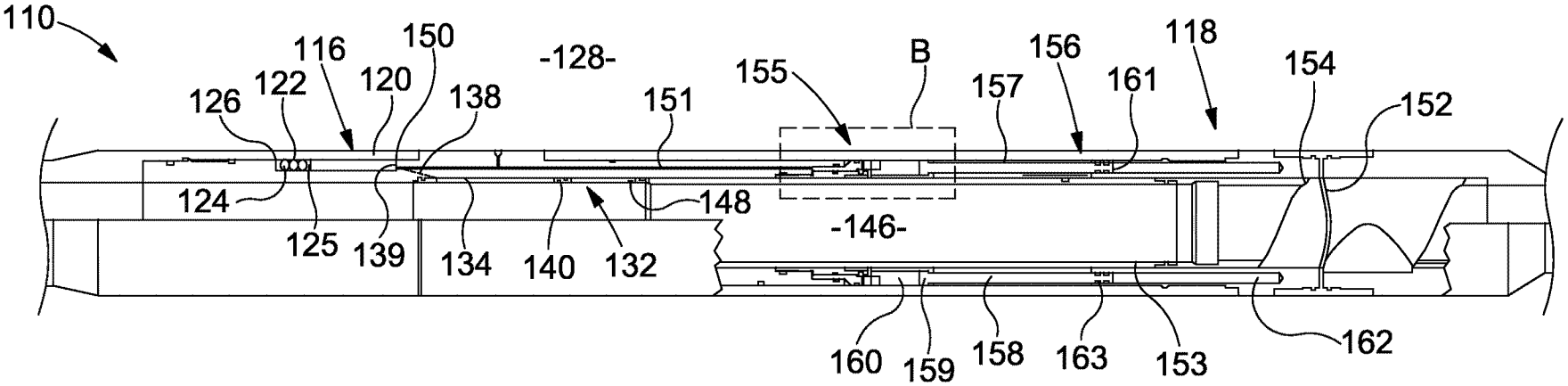
FIG. 6A is a diagrammatic illustration of a completion system which includes a pressure operated apparatus according to another embodiment of the present invention, wherein the completion system includes a barrier in a closed configuration.

FIG. 6A is a partial cross-sectional diagrammatic illustration of a completion system, generally identified by reference numeral 110. The completion system 110 includes a pressure operated apparatus, generally identified by reference numeral 116, and a downhole tool 118 which is to be actuated by or via the apparatus 116.

The apparatus 116 is provided within a wall region 120 of the completion system 110. A flexible reservoir tube 122 containing a compressible fluid 124, such as Silicon oil, is in communication with the apparatus 116 via port 125. In the present embodiment the reservoir tube 122 is formed of an elastic material, for example a rubber such as Viton, which is coiled or laid in serpentine form within a pocket 126 formed in the wall region 120. The pocket 126 is in communication with a space 128 external of the completion system 110 (which may be a wellbore annulus), such that external pressure may act on the outer surface of the tube 122, and thus impart the pressure to the compressible fluid 124. As will be described in more detail below, the reservoir tube 122 and compressible fluid 124 function as a biasing arrangement within the apparatus 116.

The completion system 110 includes a pressure transfer arrangement, generally identified by reference numeral 132, which includes a reservoir of a pressure transfer fluid 134 provided in an annular space 136, wherein the pressure transfer fluid 134 is in communication with the apparatus 116 via communication path illustrated by broken line 138 and port 139. The pressure transfer arrangement 132 further comprises an annular piston 140 positioned within the annular space 136, and sealed against the inner and outer walls of the annular space 136. The annular piston 140 is arranged such that one side thereof is in communication with the pressure transfer fluid 134, and an opposing side is in communication with a central bore 146 of the completion system 110 via ports 148. Accordingly, the pressure of the pressure transfer fluid 134, and thus the pressure delivered to the apparatus 116, may be substantially equalised with the internal pressure of the completion system 110. The provision of the annular piston 140 provides the ability to impart the completion pressure into the pressure transfer fluid 134, while minimising the risk of fluid contamination, which may otherwise compromise the apparatus 116.

The apparatus 116 includes or defines a relief port 150 which is in fluid communication with the tool 118 via flow path 151. As will be described in more detail below, the apparatus 116 functions to prevent pressure/fluid relief from a portion of the tool 118 to allow the tool to be retained in a locked configuration. Pressure within the completion system 110 may be varied by a user or operator in a defined sequence to operate the apparatus 116 to eventually allow fluid/pressure relief from the tool 118, to permit actuation of said tool 118.

The tool 118 comprises a frangible barrier 152 which is initially provided to block the central bore 146 of the completion system 110. The tool 118 further includes a flow tube 153 which is arranged to slide axially within the central bore 146 of the completion system 110, wherein the flow tube 153 defines a cutting end 154 which can be used to cut through and remove the frangible barrier 152, as described in more detail below.

In the initial configuration shown in FIG. 6A with the frangible barrier 152 in place, the flow tube 153 is axially locked relative to the completion system 110 via a locking mechanism, generally identified by reference numeral 155 and described in detail below.

The tool 110 also includes an actuator arrangement, generally identified by reference numeral 156, located within an annular cavity 157 in a wall structure of the completion system 110. The actuator arrangement 156 includes an annular piston member 158 which is connected at a first end 159 to the flow tube 153 via a piston interface 160, with a second end 161 of the piston member 158 received within a piston chamber 162. In the configuration illustrated the piston member 158 is extended from the piston chamber, and retained in this extended position by the locking mechanism 155. The second end 161 includes a sealing arrangement 163 which provides isolation between the piston chamber 162 and the annular cavity 157.

In the present embodiment the piston chamber 162 is at atmospheric pressure, while the annular cavity 157 is exposed to the pressure within the external space 128 (wellbore annulus). Accordingly, a pressure differential may be achieved across the sealing arrangement 163 which can be used to cause the piston member 158 to stroke and move the flow tube 153, once the locking mechanism 155 is released.

Figure 6B:
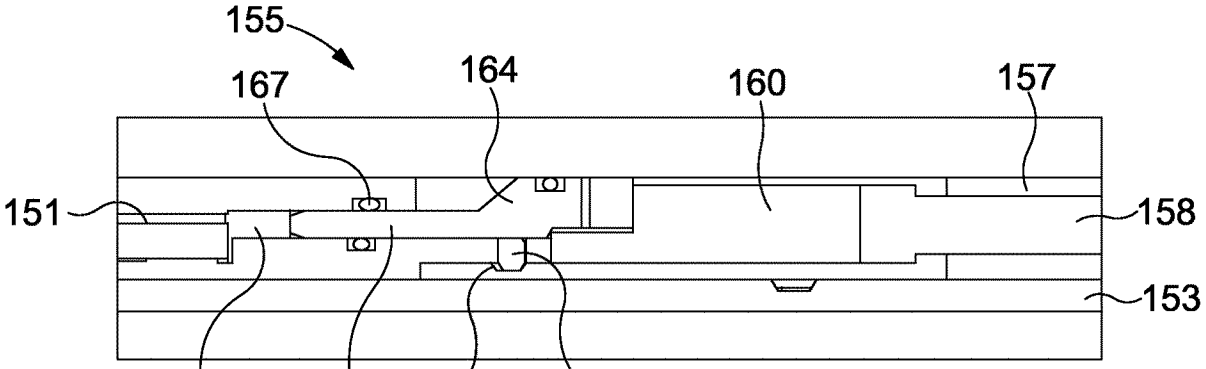
FIG. 6B is an enlarged view of the region B in FIG. 6A.

An enlarged view of a portion of the locking mechanism 155 in region B of FIG. 6A is illustrated in FIG. 6B. The locking mechanism 155 includes a locking sleeve 164 including a first annular portion 165 which is received within an annular space 166 in communication with the flow path 151 which extends to the pressure operated apparatus 116. A sealing arrangement 167 provides sealing between the first annular portion 165 and the annular space 166. In an initial configuration the pressure operated apparatus 116 does not permit any relief of fluid within the annular space 166 or the flow path 151, such that the locking sleeve 164 is hydraulically locked in a locking position.

When in the illustrated locking position the locking sleeve 164 radially restrains a locking member 168 within a recess 169 formed in the piston interface 160, thus retaining the piston interface 160, and connected flow tube 153, in a locked configuration. The locking member 168 may comprise one or a number of dogs, a split ring or the like.

The form and sequential operation of the pressure operated apparatus will now be described with reference to FIGS. 7A to 7D. It should be noted that the apparatus 116 is similar to apparatus 16 described above in many respects and as such like features share like reference numerals, incremented by 100.

Figure 7A:
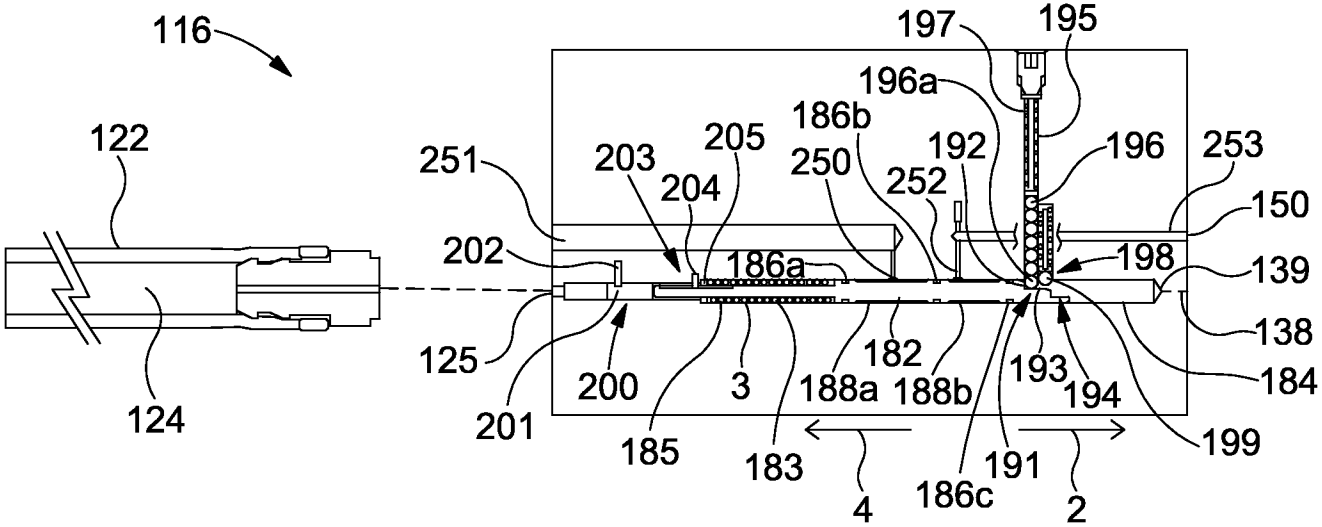
FIGS. 7A to 7D are diagrammatic sequential illustrations of the use of a downhole pressure operated apparatus in accordance with an alternative embodiment of the present invention.

Referring initially to FIG. 7A the apparatus 116 includes a piston member 182 mounted within a piston bore 183 to define a first chamber 184 on one side of the piston member 182 and a second chamber 185 on an opposite side of the piston member 182.

The first chamber 184 is provided in communication with the pressure transfer fluid 134 (FIG. 6A) via communication path 138 and port 139. Thus, the pressure within the completion system 110 is applied within the first chamber 184. The second chamber 185 is in communication with the compressible fluid 124 within the tube 122 via port 125. Thus, the pressure within the tube 122, which may be equalised with the pressure in the space 128 external to the completion system 110 (the wellbore annulus), is applied within the second chamber 185.

It will be recognised that the pressure of the compressible fluid 124 applied within the second chamber 185 will act on the piston member 182 to urge said piston member 182 to axially move within the piston bore 183 in a first direction, illustrated by arrow 2. Further, in addition to the action of the pressure of the compressible fluid 124, the piston member 182 is also biased in the first direction 2 by a spring 3.

The pressure of the pressure transfer fluid 124 applied within the first chamber 184 will act on the piston member 182 to urge said piston member 182 to axially move within the piston bore 183 in an opposite second direction, illustrated by arrow 4. Thus movement of the piston member will be provided in accordance with the resolution of the various forces applied on the piston member 182 in the first and second directions 2, 4, and also in accordance with a locking arrangement, which will be described below.

Three axially spaced O-ring seals 186*a*, 186*b*, 186*c* are mounted on the piston member 182 and provide sealing between the piston member 182 and the piston bore 183, isolating the first and second chambers 184, 185. A first axial space 188*a* is defined between the O-rings 186*a*, 186*b*, and a second axial space 188*b* is defined between the O-rings 186*b*, 186*c*. In the illustrated initial configuration the piston member 182 is positioned such that the O-rings 186*a*, 186*b* and axial space 188*a* straddle a port 250 of an atmospheric chamber 251, while O-rings 186*b*, 186*c* and axial space 188*b* straddle a port 252 of an internal flow path 253 which leads to port 150. Accordingly, ports 250, 252 are isolated from each other such that the fluid which provides hydraulic locking of the locking sleeve 164 (FIGS. 6A and 6B) is trapped between the locking sleeve 164 and the piston member 182, preventing actuation of the tool 118.

One end of the piston member 182 comprises a locking profile which includes a locking notch 191 having an axially facing locking surface 192 and a radially facing support surface 193. The locking profile also includes a relief notch 194 provided axially adjacent the locking notch 191.

The apparatus 116 further comprises a cavity 195 in the form of a drilled bore which opens into the piston bore 183. A plurality of locking members 196 in the form of balls are stacked within the cavity 195, and are biased by a spring arrangement 197 towards the piston bore 183. With the piston member 182 in its initial illustrated position/configuration a first locking member 196*a* extends from the cavity 195 and only partially into the piston bore 183, being supported by the radial support surface 193 of the locking profile. When in this position the axial locking surface 192 of the locking profile axially engages the first locking member 196*a*, such that said locking member 196*a* restricts movement of the piston member 182 in the first direction 2, thus maintaining the piston member 182 in a lock configuration.

The apparatus 116 also comprises a lock member restrictor 198 which includes a spring mounted ball 199. The purpose and function of the lock member restrictor 198 will become apparent from the description below.

The apparatus 116 further comprises a releasable mechanism 200 which includes a rod 201 secured within the piston bore 183 via one or more shear screws or pins 202. When in the initial configuration as illustrated in FIG. 7A, the releasable mechanism 200 prevents any movement of the piston member 182 in the second direction 4, at least until the releasable mechanism 200 is released by shearing of the screws or pins 202.

The apparatus 116 further comprises an anti-rotation arrangement 203 which includes a key 204 extending from a side wall of the piston bore 183 and received within an axial keyway 205 formed in the piston member 182. In use, the anti-rotation arrangement 203 permits axial movement of the piston member 182, but prevents rotational movement, thus maintaining correct alignment of the locking profile.

Figure 7B:
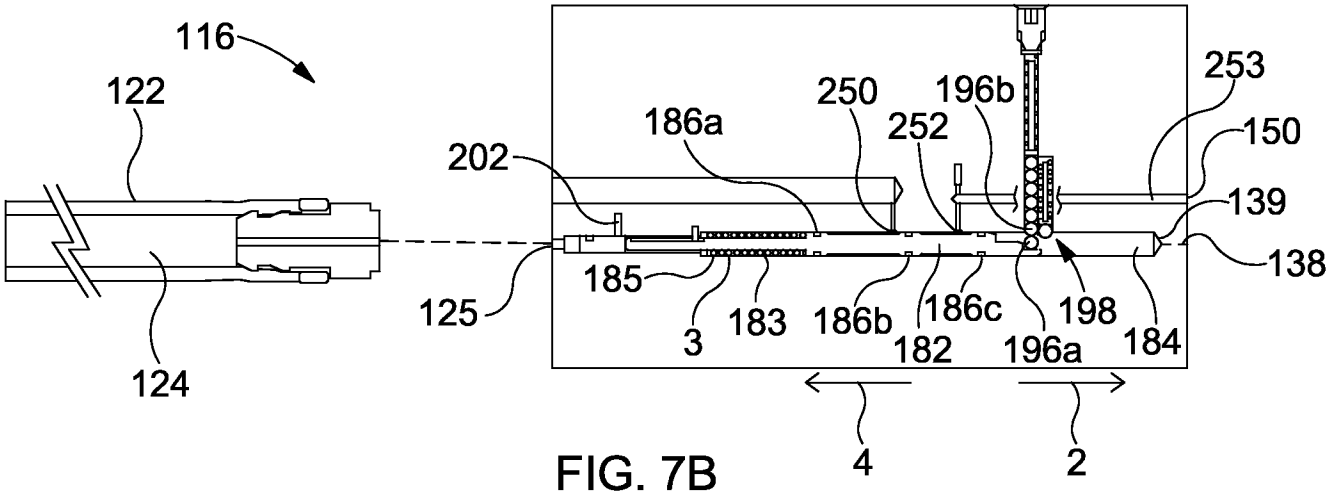

Referring to FIG. 7B, when the apparatus 116 is to be operated pressure within the completion system 110 (within bore 146—FIG. 6A) is elevated, thus increasing the pressure within the first chamber 184. This increase of pressure within the first chamber 184 may be defined as a first pressure event. When this first pressure event generates a force on the piston member 182 which exceeds the rating of the shear screws or pins 202, in combination with the bias force from the spring 3 and the compressible fluid 124 acting in the second chamber 185, the piston member 182 will move axially in the second direction 4. This will cause the first lock member 196*a* to become aligned with the relief notch 194 of the locking profile on the piston member 182, permitting the first lock member 196*a* to be wholly received within the piston bore 183, specifically within the first chamber 184. A subsequent or second lock member 196*b* then becomes partially extended into the piston bore 183. The second lock member 196*b* is prevented from wholly entering the piston bore 183 by the first lock member 196*a*, which is retained by the lock member restrictor 198.

When in this configuration the fluid ports 250, 252 remain isolated, such that the tool 118 is not yet actuated.

Figure 7C:
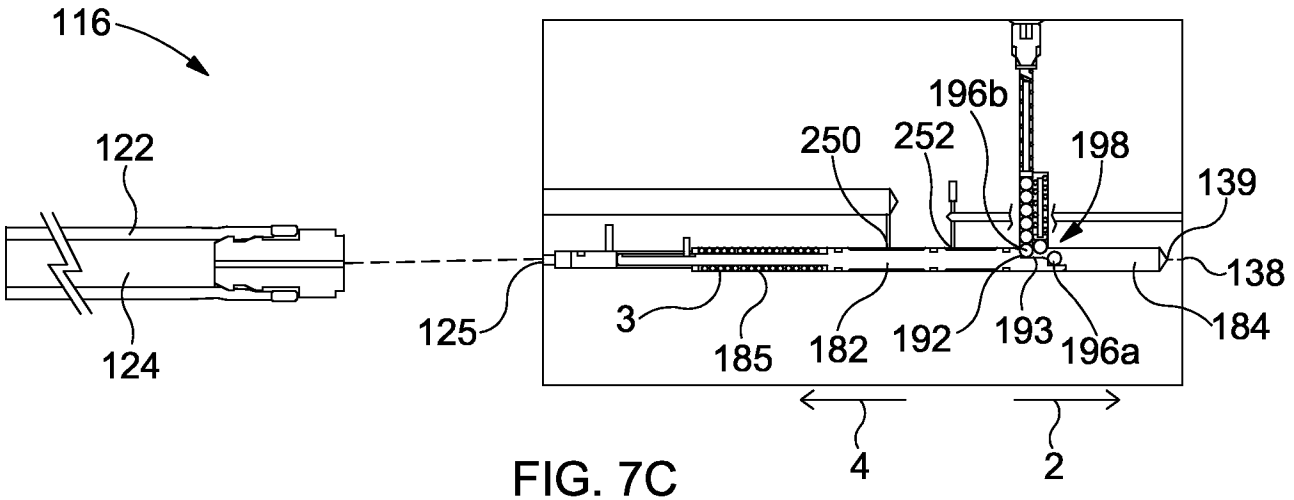

Following this, as illustrated in FIG. 7C, the pressure within the completion system 110 (within bore 146—FIG. 6A) is reduced, thus reducing the pressure within the first chamber 184. This reduction of pressure within the first chamber 184 may be defined as a second pressure event. When the combined resultant force of the bias spring 3 and the pressure of the compressible fluid 24 acting in the second chamber 185 exceeds that provided by pressure within the first chamber 184, the piston member 182 will move axially in the first direction 2. Such movement will force the first lock member 196*a* past the lock member restrictor 198, and will allow the second lock member 196*b* to become supported by the radial support surface 193 of the locking profile of the piston member 182. Thus, the second lock member 196*b* now restricts further movement of the piston member 182 in the first direction 2 by engagement with the axial locking surface 192 of the locking profile on the piston member 182. The fluid ports 250, 252 thus remain isolated.

Figure 7D:
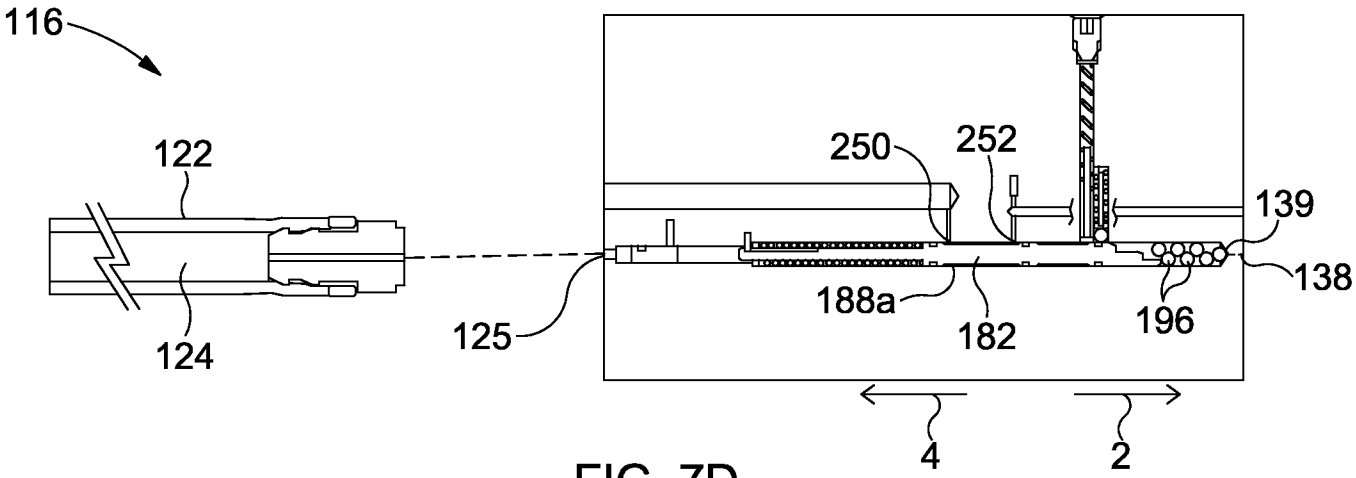

The first and second pressure events (increasing and then decreasing pressure) may collectively define a pressure cycle which establishes a single count within the apparatus 116. Such a pressure cycle may be repeated until all locking members 196 wholly enter the piston bore 183, as illustrated in FIG. 7D. When in this configuration the piston member 182 is no longer restricted and is free to move further in the first direction 2, until the fluid ports 250, 252 become straddled within the first axial space 188*a* and thus in communication with each other, thus permitting relief of the fluid causing the hydraulic locking of the locking sleeve 164 (FIGS. 6A and 6B). This final configuration of the piston member 182 may be defined as its unlock configuration. Although not illustrated, the piston member 182 may be mechanically secured, for example by a snap-ring, within this unlock configuration.

Figure 8A:
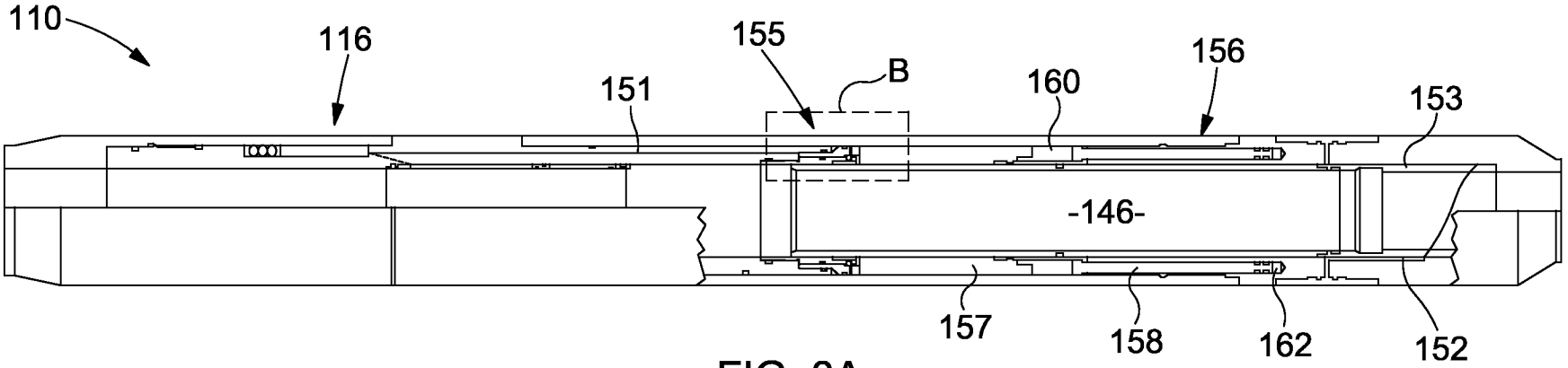
FIG. 8A illustrates the completion system of FIG. 6A with the barrier removed.
Figure 8B:
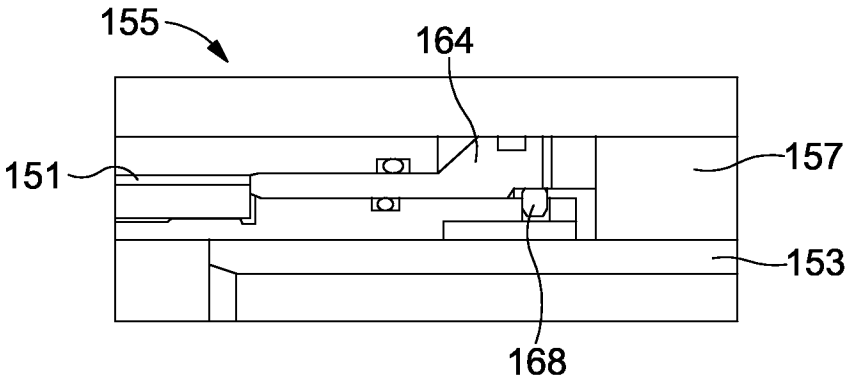
FIG. 8B is an enlarged view of the region B in FIG. 8A.

As illustrated in FIGS. 8A and 8B (which is an enlarged view of region B in FIG. 8A), once the fluid is relieved pressure acting within annular cavity 157 displaces the locking sleeve 164 to desupport the locking member 168, releasing the piston interface 160 and thus flow tube 153, such that the pressure differential between the annular cavity 157 and the atmospheric piston chamber 162 may cause the piston member 158 to stroke into the atmospheric chamber 162, driving the flow tube to pierce and remove the frangible barrier 152, thus opening the central bore 146 of the completion system 110.

In the apparatus 116 the piston member 182 is biased by a combination of the compressible fluid 124 and the spring 3. However, other biasing arrangements are possible. For example, biasing may be achieved by only one arrangement, such as by a fluid or by a spring.

Figure 9:
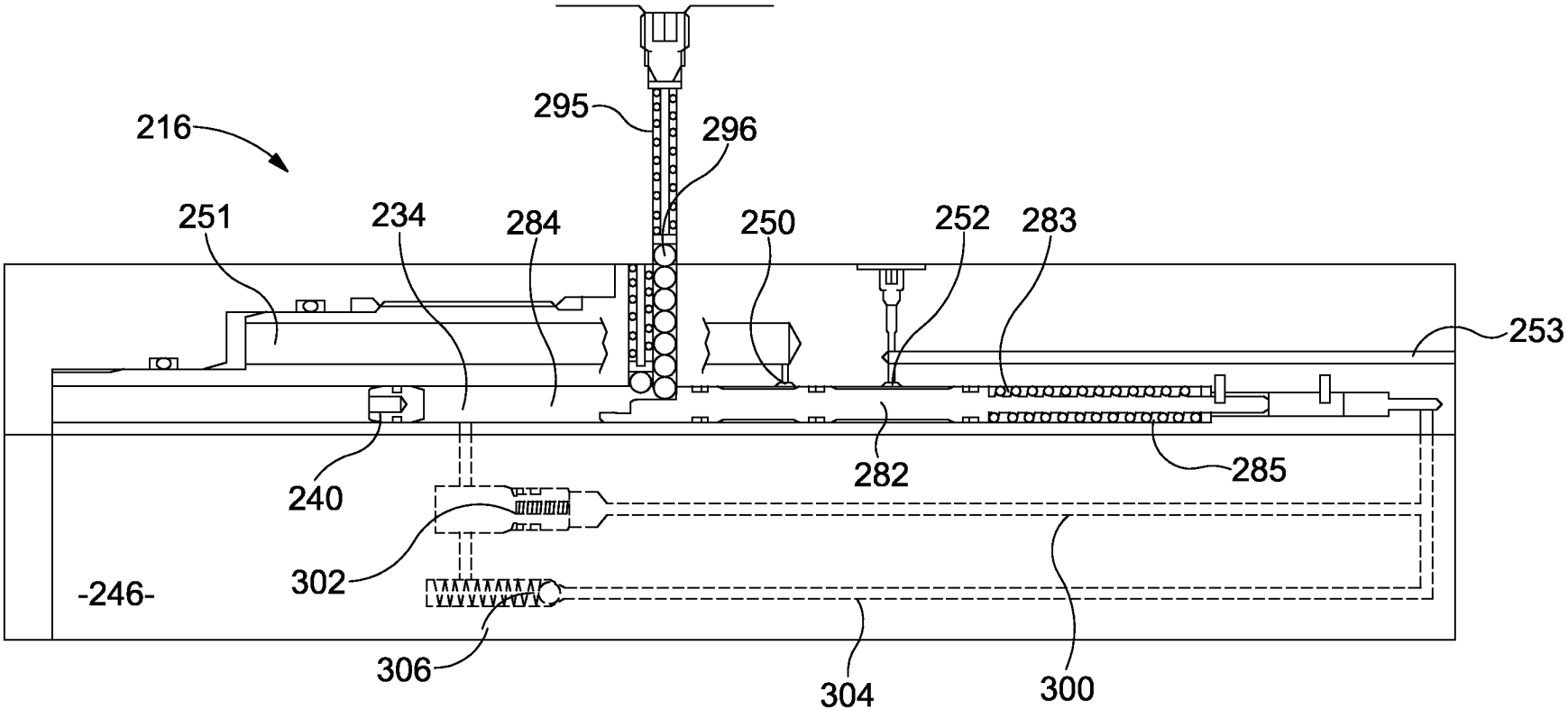
FIG. 9 is a diagrammatic illustration of a pressure operated apparatus in accordance with a further alternative embodiment.

A further exemplary biasing arrangement within a pressure operated apparatus, generally identified by reference numeral 216, will now be described with reference to FIG. 9. The embodiment of FIG. 9 is very similar to that described above with reference to FIGS. 6A to 8B, and as such like features share like reference numerals, incremented by 100.

Thus, apparatus 216 includes a piston member 282 mounted within a piston bore 283 to define a first chamber 284 on one side of the piston member 282 and a second chamber 285 on an opposite side of the piston member 282. The apparatus 216 includes the same counting mechanism as in other embodiments, including multiple locking members 296 stacked within a cavity 295, wherein the locking members 296 selectively engage a locking profile on the piston member 282. For brevity the form and function of this mechanism will not be repeated. It is noted, however, that the cavity 295 and locking members 296 are shown enlarged relative to the remainder of the apparatus 216 for purposes of clarity.

As in apparatus 116 described above, the piston member 282 initially prevents communication between an atmospheric chamber 251 and a flow path 253 which contains locked hydraulic fluid.

The first chamber 284 is provided in communication with a compressible pressure transfer fluid 234 which is equalised with pressure within a central bore 246 of a completion via an annular piston 240. Thus, the pressure within the completion system is applied within the first chamber 284.

A first flow path 300 is provided between the first chamber 284 and the second chamber 285, wherein the first flow path 300 includes a fluid restriction 302. A second flow path 304 extends between the first and second chambers 284, 285, wherein the second flow path 304 includes a check valve 306 which only permits flow via the second flow path from the second chamber 285 to the first chamber 284.

During deployment of the apparatus 216 into a wellbore, increasing hydrostatic pressure will cause the pressure transfer medium 234, acted upon by the annular piston 240, to flow through the first flow path 300, via the fluid restriction 302, to eventually achieve pressure equalisation between the first and second chambers 284, 285.

When pressure within the central bore 246 is increased (a first pressure event) the piston member 240 will move to compress the pressure transfer fluid 234, with fluid movement from the first chamber 284 towards the second chamber 285 only permitted through the first flow path 300 and the fluid restriction 302. The fluid restriction 302 may therefore establish a back pressure within the first chamber 284, permitting a pressure differential between the first and second chambers 284, 285 to be established, causing movement of the piston member 282. Such movement in this case may be permitted by virtue of compressibility of the pressure transfer fluid 234 within the second chamber 285.

When pressure within the central bore 246 is decreased (a second pressure event), the pressure within the first chamber 284 will begin to reduce, allowing fluid pressure within the second chamber 285, working in conjunction with spring 3, to return the piston member 282. In this respect, for a more rapid pressure equalisation between the first and second chambers 284, 285, and thus the ability to apply a subsequent pressure cycle sooner, pressure/fluid may be relieved via the second flow path 304 and check valve 306.

It should be understood that the embodiments described herein are merely exemplary and that various modifications may be made thereto without departing from the scope of the invention.

The invention claimed is:

1. A downhole pressure operated apparatus, comprising:

a piston member mounted within a piston bore and being reconfigurable from a lock configuration to an unlock configuration in response to a pressure sequence applied within the piston bore, wherein the piston member comprises a lock profile; and a lock member arranged in a cavity which opens into the piston bore, wherein when the piston member is in the lock configuration the lock member is supported by the piston member such that the lock member partially extends into the piston bore and engages the lock profile of the piston member to restrict movement of the piston member in a first direction towards the unlock configuration, wherein in response to a first pressure event of the pressure sequence the piston member is moveable in a second direction to desupport the lock member and permit said lock member to be wholly received into the piston bore and allow the piston member to move in the first direction towards the unlock configuration in response to a subsequent second pressure event of the pressure sequence.

2. The downhole pressure operated apparatus according to claim 1, wherein the first and second pressure events collectively define a pressure cycle of the pressure sequence.

3. The downhole pressure operated apparatus according to claim 1, wherein at least one of the first pressure event and the second pressure event comprises pressure modified within the piston bore on at least one side of the piston member and being configured to cause a variation in a pressure differential across the piston member.

4. The downhole pressure operated apparatus according to claim 1, wherein the first pressure event comprises one of increasing or decreasing pressure within the piston bore, and the second pressure event comprises the other of increasing or decreasing the pressure within the piston bore.

5. The downhole pressure operated apparatus according to claim 1, comprising a plurality of the lock members located within the cavity, wherein, in use, the lock members sequentially engage and release the piston member in response to multiple sequential ones of the pressure events applied within the piston bore until a final lock member of the plurality of lock members is wholly received into the piston bore, allowing the piston member to move in the first direction towards the unlock configuration.

6. The downhole pressure operated apparatus according to claim 5, wherein, in use, a first lock member of the plurality of lock members is initially supported by the piston member such that the first lock partially extends into the piston bore and engages the lock profile of the piston member to restrict movement of the piston member in the first direction towards the unlock configuration, and in response to the first pressure event applied within the piston bore the piston member is moveable in the second direction to desupport the first lock member and permit said first lock member to be wholly received into the piston bore, and in response to the second pressure event applied within the piston bore the piston member is moveable in the second direction until a second lock member of the plurality of lock members becomes supported by the piston member such that the second lock member partially extends into the piston bore and engages the lock profile of the piston member to restrict movement of the piston member in the first direction towards its the unlock configuration.

7. The downhole pressure operated apparatus according to claim 5, comprising a restrictor being configured to prevent multiple ones of the lock members from being received into the piston bore during a single movement of the piston member in response to a single one of the pressure events in the piston bore.

8. The downhole pressure operated apparatus according to claim 1, wherein the lock profile of the piston member comprises:

an axial lock surface which axially engages the lock member to restrict axial movement of the piston member in the first direction; and a radial support surface which supports the lock member in a position which is partially extended into the piston bore, wherein movement of the piston member in the second direction misaligns the lock member from the radial support surface, allowing the lock member to be desupported and wholly received within the piston bore.

9. The downhole pressure operated apparatus according to claim 1, wherein the piston bore is connectable to at least one of i) an internal volume of a tubing string, such that pressure within the tubing string is applied within the piston bore, and ii) a wellbore annulus region, such that pressure within the wellbore annulus region is applied within the piston bore.

10. The downhole pressure operated apparatus according to claim 1, wherein the piston member is biased by a biasing force in one of the first and second directions, such that a pressure applied within the piston bore acts together with the biasing force to facilitate movement of the piston member in the first and second directions, and wherein in a first operation a first of the pressure applied within the piston bore establishes a force on the piston member to overcome the biasing force and thus cause movement of the piston member in the desired direction.

11. The downhole pressure operated apparatus according to claim 1, comprising a control which facilitates controlled communication of a medium between opposing first and second sides of the piston member, such that the same medium is used as both a medium to apply the pressure event within the piston bore on the first side of the piston member while at the same time providing a biasing force on the opposite second side of the piston member.

12. The downhole pressure operated apparatus according to claim 11, wherein the control comprises a first flow path comprising a fluid restriction which permits at least one of:

the opposing first and second sides of the piston member to become pressure balanced in a static mode of operation; and a back pressure to be generated on one of the first and second sides of the piston member during a dynamic mode of operation in which the medium flows through the fluid restriction in a first flow direction from the first side to the second side of the piston member, such that the back pressure permits the pressure on the first side of the piston member to be elevated above the pressure on the second side of the piston member to establish a pressure differential to move the piston member.

13. The downhole pressure operated apparatus according to claim 12, wherein the medium is compressible to permit movement of the piston member when the pressure differential is present.

14. The downhole pressure operated apparatus according to claim 12, wherein the control comprises a second flow path comprising a one way valve which permits flow therethrough in a second flow direction from the second side of the piston member to the first side to provide relief of fluid from the second side of the piston member.

15. The downhole pressure operated apparatus according to claim 1, wherein the piston member is mounted within the piston bore to define first and second chambers, and wherein the lock member is received within one of the first and second chambers during reconfiguring of the piston member in response to the pressure sequence.

16. The downhole pressure operated apparatus according to claim 1, wherein the piston member defines at least one of a mechanical lock and a valve member.

17. The downhole pressure operated apparatus according to claim 1, wherein a fluid isolation provided when the piston member is in the lock configuration maintains a hydraulic lock in one of a first and second fluid zones, with the hydraulic lock released when the piston member is configured in the unlock configuration.

18. A downhole method, comprising:

providing a piston member of a pressure operated apparatus in an initial lock configuration within a piston bore, wherein said piston member is retained in said lock configuration by a lock member which is supported by the piston member such that the lock member partially extends into the piston bore and engages a lock profile of the piston member to restrict movement of the piston member in a first direction towards an unlock configuration;

establishing a first pressure event within the piston bore to move the piston member in a second direction to desupport the lock member and permit said lock member to be wholly received into the piston bore; and establishing a second pressure event within the piston bore to move the piston member in the first direction towards the unlock configuration and facilitate an associated operation.

19. The method according to claim 18, comprising providing multiple of the lock members which sequentially engage and retain the piston member in the lock configuration upon applying multiple pressure cycles comprising the first and second pressure events within the piston bore, until a final lock member of the lock members is wholly received into the piston bore, allowing the piston member to move in the second direction towards the unlock configuration.

20. A pressure operated apparatus, comprising:

a piston member mounted within a piston bore and being reconfigurable from a lock configuration to an unlock configuration to facilitate an associated operation; and a plurality of lock members, arranged to sequentially restrict movement of the piston member towards the unlock configuration, wherein the piston member is reciprocally moveable within the piston bore in response to sequential pressure events applied within the piston bore to sequentially move the lock members from a first retaining position to a second release position, until all of the lock members are moved to the second release position to permit the piston member to be reconfigured to the unlock position, wherein a first of the sequential pressure events moves the piston member in a second direction, and a second of the sequential pressure events moves the piston member in a first direction; and wherein the first and second sequential pressure events collectively define a pressure cycle of the pressure sequence.

* * * * *